US010280928B2

(12) United States Patent
Hossain et al.

(10) Patent No.: US 10,280,928 B2
(45) Date of Patent: May 7, 2019

(54) CENTRIFUGAL COMPRESSOR WITH SURGE PREDICTION

(71) Applicant: Daikin Applied Americas Inc., Minneapolis, MN (US)

(72) Inventors: Md Anwar Hossain, Maple Grove, MN (US); Nobuhiro Umeda, Plymouth, MN (US); Takatoshi Takigawa, St. Louis Park, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 669 days.

(21) Appl. No.: 14/873,573

(22) Filed: Oct. 2, 2015

(65) Prior Publication Data

US 2017/0097006 A1 Apr. 6, 2017

(51) Int. Cl.
*F04D 17/10* (2006.01)
*F04D 27/00* (2006.01)
(Continued)

(52) U.S. Cl.
CPC ..... *F04D 27/0246* (2013.01); *F04D 17/10* (2013.01); *F04D 27/001* (2013.01);
(Continued)

(58) Field of Classification Search
CPC .... F04D 27/0246; F04D 27/001; F04D 27/02; F04D 27/004; F04D 17/10; F04D 25/06;
(Continued)

(56) References Cited

U.S. PATENT DOCUMENTS 5,003,211 A * 3/1991 Groom ..... F16C 32/0451 310/90.5
5,095,714 A 5/1992 Adachi et al.
(Continued)

FOREIGN PATENT DOCUMENTS

WO 2009/055878 A2 5/2009

OTHER PUBLICATIONS

The International Search Report for the corresponding international application No. PCT/US2016/054702, dated Jan. 13, 2017.
(Continued)

*Primary Examiner* — Richard A Edgar
(74) *Attorney, Agent, or Firm* — Global IP Counselors, LLP

(57) ABSTRACT

A centrifugal compressor for a chiller includes a casing, an inlet guide vane, an impeller downstream of the inlet guide vane, a rotational magnetic bearing, a magnetic bearing sensor, a motor, a diffuser and a controller. The casing has inlet and outlet portions with the inlet guide vane disposed in the inlet portion. The impeller is attached to a shaft. The radial magnetic bearing rotatably supports the shaft. The magnetic bearing sensor detects at least one of a position signal indicative of the shaft's position and a current signal indicative of current supplied to the magnetic bearing. The motor rotates the shaft in order to rotate the impeller. The diffuser is disposed in the outlet portion downstream from the impeller. An outlet port of the outlet portion is disposed between the impeller and the diffuser. The controller is programmed to predict surge based on the position signal and/or the current signal.

10 Claims, 9 Drawing Sheets

(51) Int. Cl.

| | |
|---|---|
| ***F04D 27/02*** | (2006.01) |
| ***F25B 1/053*** | (2006.01) |
| ***F25B 31/02*** | (2006.01) |
| ***F04D 29/058*** | (2006.01) |

(52) U.S. Cl.
CPC ..... *F04D 29/058* (2013.01); *F25B 1/053* (2013.01); *F25B 31/026* (2013.01)

(58) Field of Classification Search
CPC ..... F04D 29/05; F04D 29/052; F04D 29/058; F04D 29/284; F04D 29/4206; F04D 29/444; F25B 1/04; F25B 1/053; F25B 31/026
See application file for complete search history.

(56) References Cited

U.S. PATENT DOCUMENTS

| | | | | |
|---|---|---|---|---|
| 6,463,748 | B1 | 10/2002 | Benedict et al. | |
| 2013/0156544 | A1* | 6/2013 | Sishtla | F04D 27/0261 415/1 |
| 2015/0010383 | A1* | 1/2015 | Sun | F04D 27/0246 415/1 |

OTHER PUBLICATIONS

Written Opinion and International Preliminary Report on Patentability for the corresponding international application No. PCT/US2016/054702, dated Apr. 3, 2018.

* cited by examiner

CENTRIFUGAL COMPRESSOR WITH SURGE PREDICTION

BACKGROUND

Field of the Invention

The present invention generally relates to a centrifugal compressor. More specifically, the present invention relates to a centrifugal compressor with surge prediction.

Background Information

A chiller system is a refrigerating machine or apparatus that removes heat from a medium. Commonly a liquid such as water is used as the medium and the chiller system operates in a vapor-compression refrigeration cycle. This liquid can then be circulated through a heat exchanger to cool air or equipment as required. As a necessary byproduct, refrigeration creates waste heat that must be exhausted to ambient or, for greater efficiency, recovered for heating purposes. A conventional chiller system often utilizes a centrifugal compressor, which is often referred to as a turbo compressor. Thus, such chiller systems can be referred to as turbo chillers. Alternatively, other types of compressors, e.g. a screw compressor, can be utilized.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the medium (liquid) to the refrigerant, and the liquid is chilled. The refrigerant from the evaporator is then returned to the centrifugal compressor and the cycle is repeated. The liquid utilized is often water.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller increases the velocity of refrigerant gas, generally without changing pressure. The diffuser increases the refrigerant pressure without changing the velocity. The motor rotates the impeller. The controller controls the motor, the inlet guide vane and the expansion valve. In this manner, the refrigerant is compressed in a conventional centrifugal compressor. The inlet guide vane is typically adjustable and the motor speed is typically adjustable to adjust the capacity of the system. In addition, the diffuser may be adjustable to further adjust the capacity of the system. The controller controls the motor, the inlet guide vane and the expansion valve. The controller can further control any additional controllable elements such as the diffuser.

When the pressure behind the compressor is higher than the compressor outlet pressure, the fluid tends to reverse or even flow back in the compressor. As a consequence, the pressure will decrease, inlet pressure will increase and the flow reverses again. This phenomenon, called surge, repeats and occurs in cycles. The compressor loses the ability to maintain the peak head when surge occurs and the entire system becomes unstable. A collection of surge points during varying compressor speed or varying inlet guide vane angle is called a surge line. In normal conditions, the compressor operates in the right side of the surge line. However, during startup/emergency shutdown, the operating point will move towards the surge line because flow is reduced. If conditions are such that the operating point approaches the surge line, flow recirculation occurs in the impeller and diffuser. The flow recirculation, which causes flow separation, will eventually cause a decrease in the discharge pressure, and flow from suction to discharge will resume. Surging can cause the compressor to overheat to the point at which the maximum allowable temperature of the unit is exceeded. Also, surging can cause damage to the thrust bearing due to the rotor shifting back and forth from the active to the inactive side. This is defined as the surge cycle of the compressor.

Therefore, techniques have been developed to predict surge. See for example U.S. Pat. No. 5,095,714.

SUMMARY

In a conventional centrifugal compressor, differential pressure between a hub side pressure and a shroud side pressure is detected. The differential pressure is then compared to set values to predict surge. While this technique works relatively well, it is desirable to predict surge more quickly and accurately.

Therefore, one object of the present invention is to provide a centrifugal compressor that predicts surge more quickly and/or accurately.

Another object of the present invention is to provide a centrifugal compressor that predicts surge without overly complicated construction and/or additional parts.

One or more of the above objects can basically be attained by providing a centrifugal compressor adapted to be used in a chiller, the centrifugal compressor including: a casing having an inlet portion and an outlet portion; an inlet guide vane disposed in the inlet portion; an impeller disposed downstream of the inlet guide vane, the impeller being attached to a shaft rotatable about a rotation axis, at least one radial magnetic bearing rotatably supporting the shaft; at least one magnetic bearing sensor arranged to detect at least one of a position signal indicative of the shaft's position and a current signal indicative of current supplied to the at least one magnetic bearing; a motor arranged and configured to rotate the shaft in order to rotate the impeller; a diffuser disposed in the outlet portion downstream from the impeller with an outlet port of the outlet portion being disposed between the impeller and the diffuser; and a controller programmed to predict surge based on the at least one of the position signal and the current signal.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
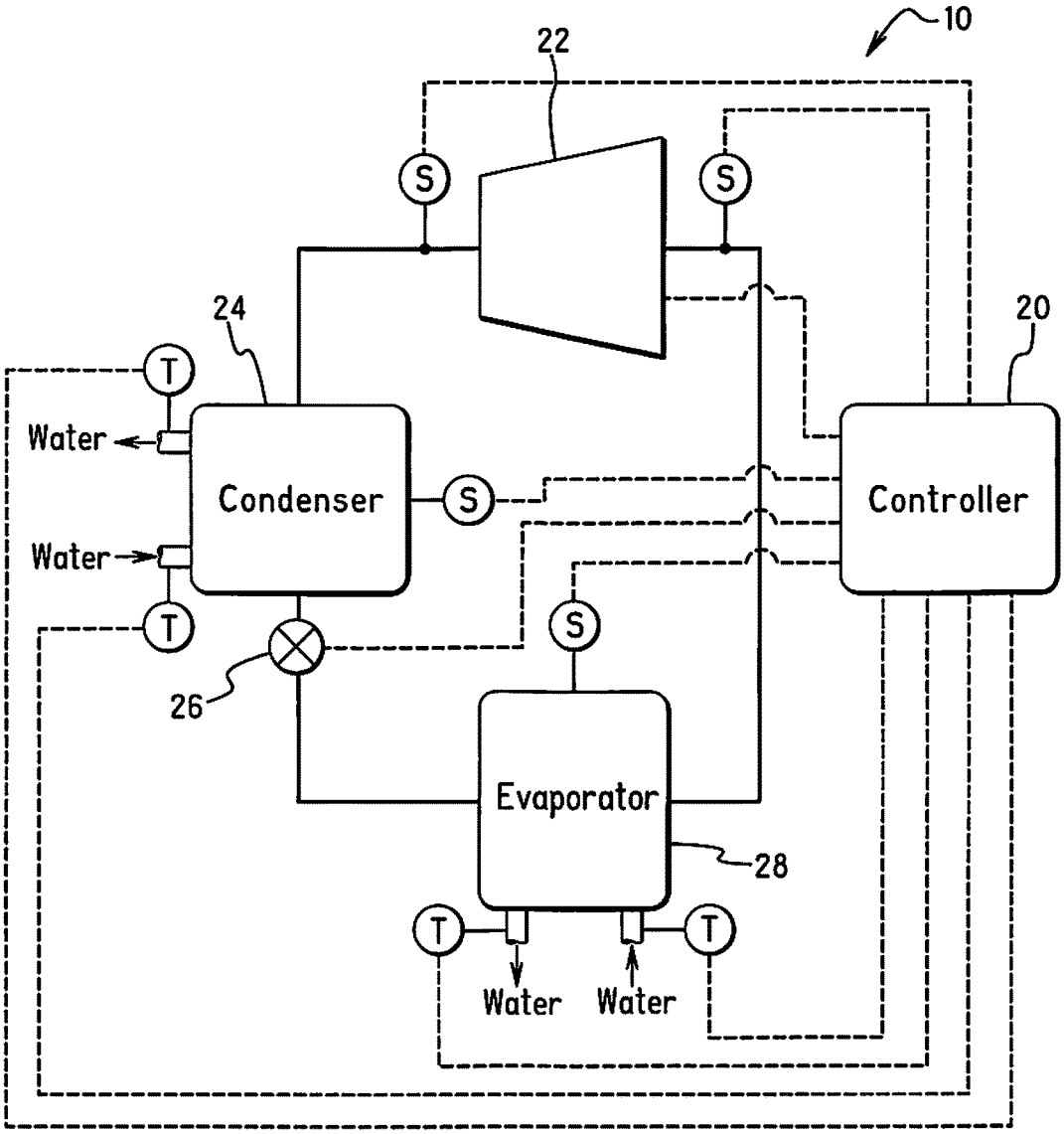
FIG. 1 illustrates a chiller in accordance with an embodiment of the present invention.

Referring initially to FIG. 1, a chiller system 10 is illustrated in accordance with an embodiment of the present invention. The chiller system 10 is preferably a water cooled chiller that utilizes cooling water and chiller water in a conventional manner. The chiller system 10 illustrated herein is a single stage chiller system. However, it will be apparent to those skilled in the art from this disclosure that the chiller system 10 could be a multiple stage chiller system. The chiller system 10 basically includes a controller 20, a compressor 22, a condenser 24, an expansion valve 26, and an evaporator 28 connected together in series to form a loop refrigeration cycle. In addition, various sensors S and T are disposed throughout the circuit as shown in FIG. 1. The chiller system 10 is conventional except that the chiller system predicts surge in accordance with the present invention.

Figure 2:
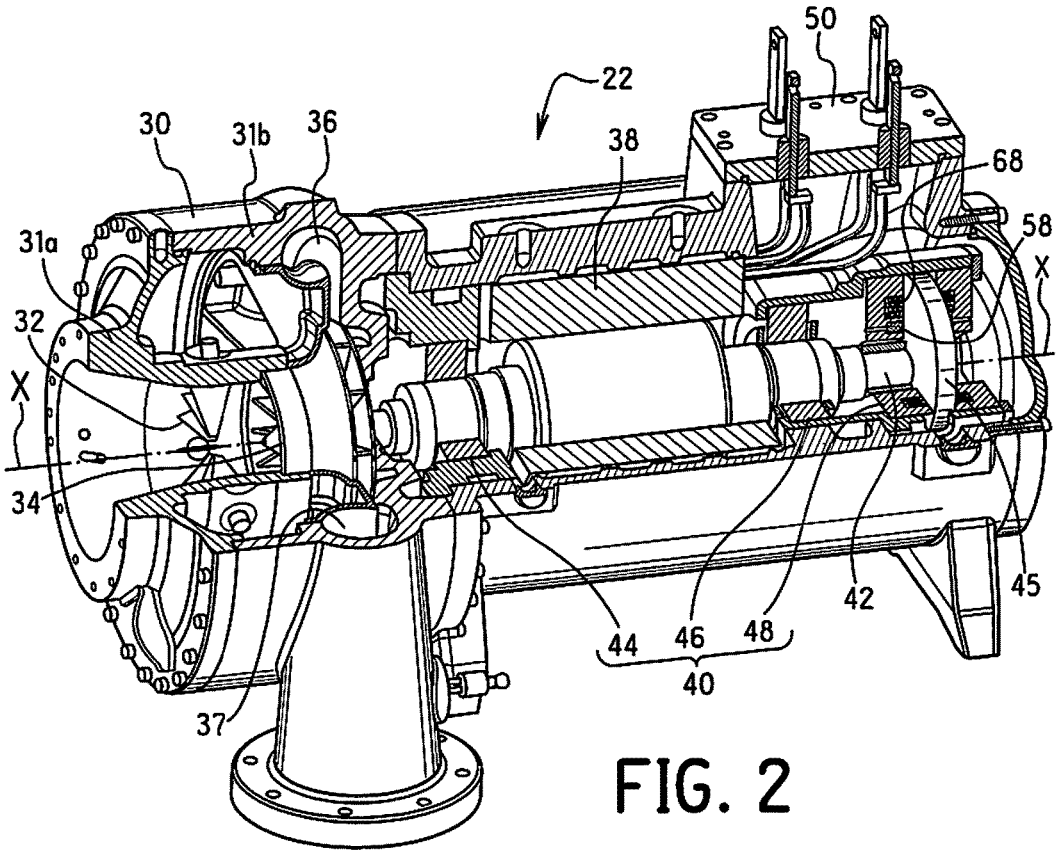
FIG. 2 is a perspective view of the centrifugal compressor of the chiller illustrated in FIG. 1, with portions broken away and shown in cross-section for the purpose of illustration.
Figure 3:
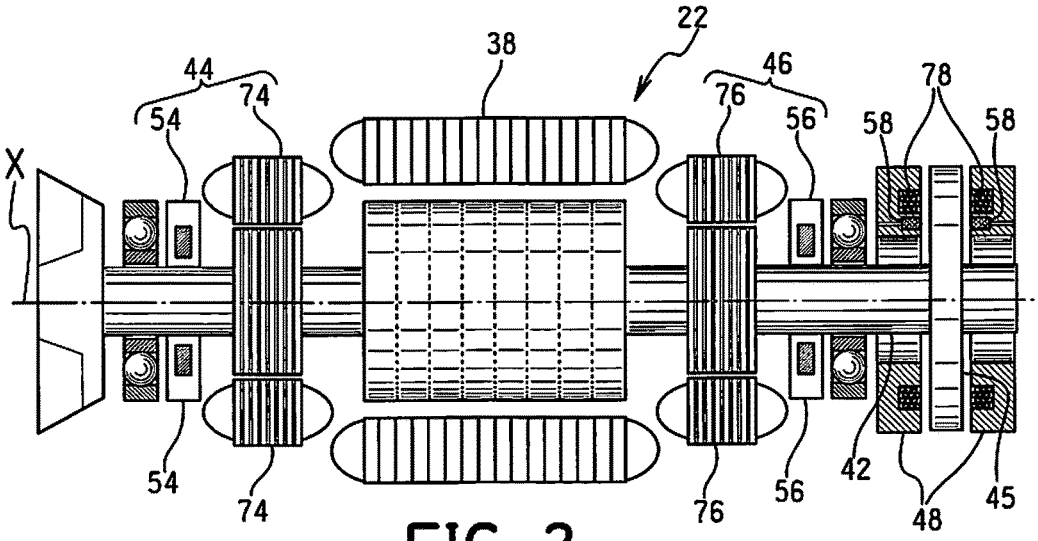
FIG. 3 is a longitudinal cross-sectional view of the impeller, motor and magnetic bearing of the centrifugal compressor illustrated in FIG. 2.

Referring to FIGS. 1-3, in the illustrated embodiment, the compressor 22 is a centrifugal compressor. The centrifugal compressor 22 of the illustrated embodiment basically includes a casing, 30, an inlet guide vane 32, an impeller 34, a diffuser 36, a motor 38 and a magnetic bearing assembly 40 as well as various conventional sensors. The controller 20 receives signals from the various sensors and controls the inlet guide vane 32, the motor 38 and the magnetic bearing assembly 40 in a conventional manner, as explained in more detail below. Refrigerant flows in order through the inlet guide vane 32, the impeller 34 and the diffuser 36. The inlet guide vane 32 controls the flow rate of refrigerant gas into the impeller 34 in a conventional manner. The impeller 34 increases the velocity of refrigerant gas, generally without changing pressure. The motor speed determines the amount of increase of the velocity of refrigerant gas. The diffuser 36 increases the refrigerant pressure without changing the velocity. The motor 38 rotates the impeller 34 via a shaft 42. The magnetic bearing assembly 40 magnetically supports the shaft 42. In this manner, the refrigerant is compressed in the centrifugal compressor 22.

The centrifugal compressor 22 is conventional, except that the centrifugal compressor 22 predicts surge in accordance with the present invention. In particular, controller 20 uses data received from the magnetic bearing assembly 40 of the centrifugal compressor 22 in order to predict surge. More specifically, the controller 20 in the illustrated embodiment uses a shaft position signal, a magnetic bearing current signal through a magnetic bearing controller in order to predict surge, as explained in more detail below.

Referring to FIGS. 2-3, the magnetic bearing assembly 40 is conventional, and thus, will not be discussed and/or illustrated in detail herein, except as related to predicting surge in accordance with the illustrated embodiment. Rather, it will be apparent to those skilled in the art that any suitable magnetic bearing can be used without departing from the present invention. As seen in FIG. 2, the magnetic bearing assembly 40 preferably includes a first radial magnetic bearing 44, a second radial magnetic bearing 46 and an axial (thrust) magnetic bearing 48. The first and second radial magnetic bearings 44 and 46 may be disposed on opposite axial ends of the motor 38, or can be disposed on the same axial end with respect to the motor 38 (not illustrated). Various sensors, discussed in more detail below, sense radial and axial positions of the shaft 42 relative to the magnetic bearings 44, 46 and 48, and send signals to the magnetic bearing control section 61 in a conventional manner. The magnetic bearing control section 61 then controls the electrical current sent to the magnetic bearings 44, 46 and 48 in a conventional manner to maintain the shaft 42 in the correct position. Since the operation of magnetic bearings and magnetic bearing assemblies such as magnetic bearings 44, 46 and 48 of magnetic bearing assembly 40 are well known in the art, the magnetic bearing assembly 40 will not be explained and/or illustrated in detail herein, except as related to predicting surge in accordance with the present invention. Specifically, in the illustrated embodiment, vibrations of the magnetic bearing are sensed and used to predict surge, as discussed in more detail below.

The magnetic bearing assembly 40 is preferably a combination of active magnetic bearings 44, 46, and 48, which utilizes non-contact position sensors 54, 56 and 58 to monitor shaft position and send signals indicative of shaft position to the magnetic bearing control section 61. Thus, each of the magnetic bearings 44, 46 and 48 are preferably active magnetic bearings. Each active magnetic bearings typically include a proportional-integral-derivative controller (PID controller, or PID). A PID uses information from position sensors 54, 56 and 58 to adjust the required current to the magnetic bearings 44, 46, and 48 of the bearing assembly 40 to maintain proper rotor position both radially and axially, as would be apparent in light of the disclosure. Active magnetic bearings are well known in the art, and thus, will not be explained and/or illustrated in detail herein, except as related to predicting surge in accordance with the present invention.

Figure 9A:
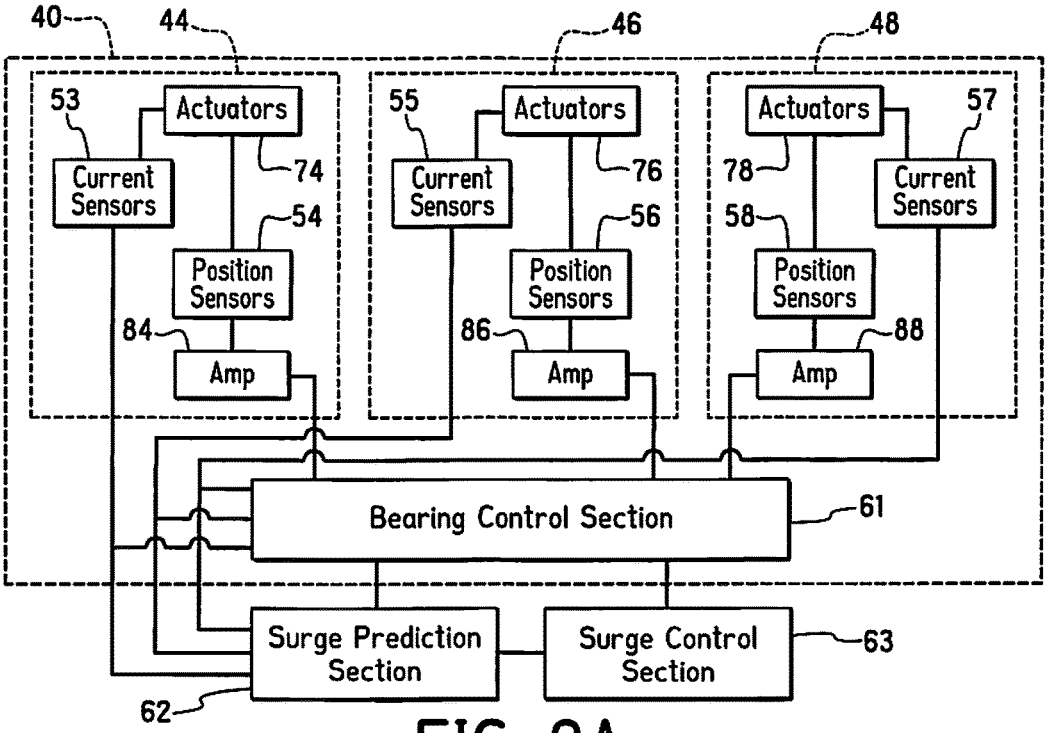
FIG. 9A is a schematic diagram illustrating a first exemplary arrangement of the magnetic bearing assembly and the magnetic bearing control section.
Figure 11:
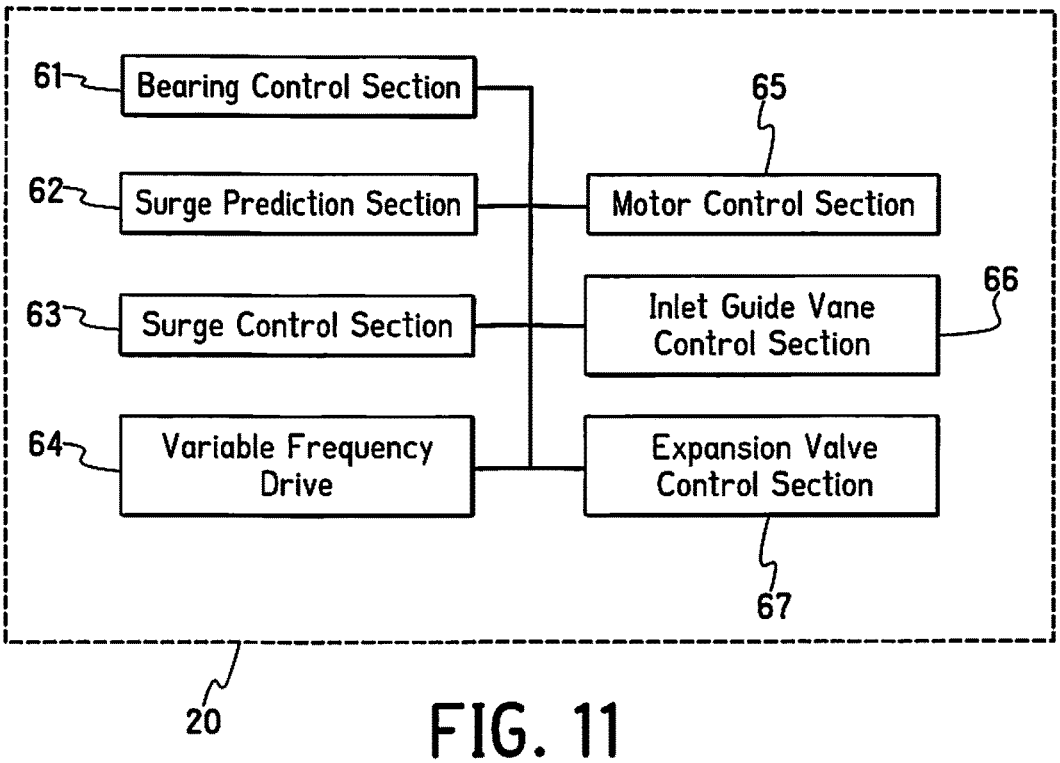
FIG. 11 is a schematic diagram illustrating the chiller controller.

Referring to FIGS. 1, 2, and 11, in the illustrated embodiment the controller 20 includes a magnetic bearing control section 61, a surge prediction section 62, a surge control section 63, a variable frequency drive 64, a motor control section 65, an inlet guide vane control section 66, and an expansion valve control section 67. The controller 20 may also include any PIDs as processes of a magnetic bearing control section 61 as illustrated in FIG. 9A. The magnetic bearing control section 61, the surge prediction section 62, the surge control section 63, the variable frequency drive 64, the motor control section 65 and the inlet guide vane control section 66 form parts of a centrifugal compressor control portion of the controller 20 that is electrically coupled to an I/O interface 50 of the compressor 22. The magnetic bearing control section 61 may be connected to current sensors 53, 55, and 57 to monitor current supplied to the magnetic bearings 44, 46, and 48 of the bearing assembly 40.

Because the magnetic bearing control section 61 is connected to several portions of the magnetic bearing assembly 40 and communicates with various sections of the controller 20, the various sections of the controller 20 can receive signals from the sensors 53 to 58 of the compressor 22, perform calculations and transmit control signals to parts of the compressor 22 such as the magnetic bearing assembly 40. Similarly, the various sections of the controller 20 can receive signals from the sensors S and T, perform calculations and transmit control signals to the compressor 22 (e.g., the motor) and the expansion valve 26. The control sections and the variable frequency drive 64 can be separate controllers or can be mere sections of the chiller controller programmed to execute the control of the parts described herein. In other words, it will be apparent to those skilled in the art from this disclosure that the precise number, location and/or structure of the control sections, control portion and/or controller 20 can be changed without departing from the present invention so long as the one or more controllers are programmed to execute control of the parts of the chiller system 10 as explained herein.

The controller 20 is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the chiller system 10. The controller 20 may optionally include an input interface such as a keypad to receive inputs from a user and a display device used to display various parameters to a user. The parts and programming are conventional, except as related to predicting surge, and thus, will not be discussed in detail herein, except as needed to understand the embodiment(s).

The magnetic bearing control section 61, either directly or indirectly from one or more PID, receives signals from the sensors 54, 56 and 58 of the magnetic bearing assembly 40, and transmits electrical signals to the bearings 44, 46 and 48 to maintain the shaft 42 in the desired position in a conventional manner during normal operation when no surge is predicted. At least one of a PID and the magnetic bearing control section 61 is programmed to execute a magnetic bearing control program to maintain the shaft 42 in the desired position in a conventional manner. In the illustrated embodiment, the magnetic bearing control section 61 may control (e.g. executes a magnetic bearing control program) the magnetic bearing assembly 40 using the hardware and/or software of controller 20. However, it will be apparent to those skilled in the art from this disclosure that the magnetic bearing control section 61 as well as the other controls sections of the controller 20 may be independently implemented by one or more additional separate controllers including the same components of controller 20, but that are connected to the controller 20 even though not illustrated.

Figure 9B:
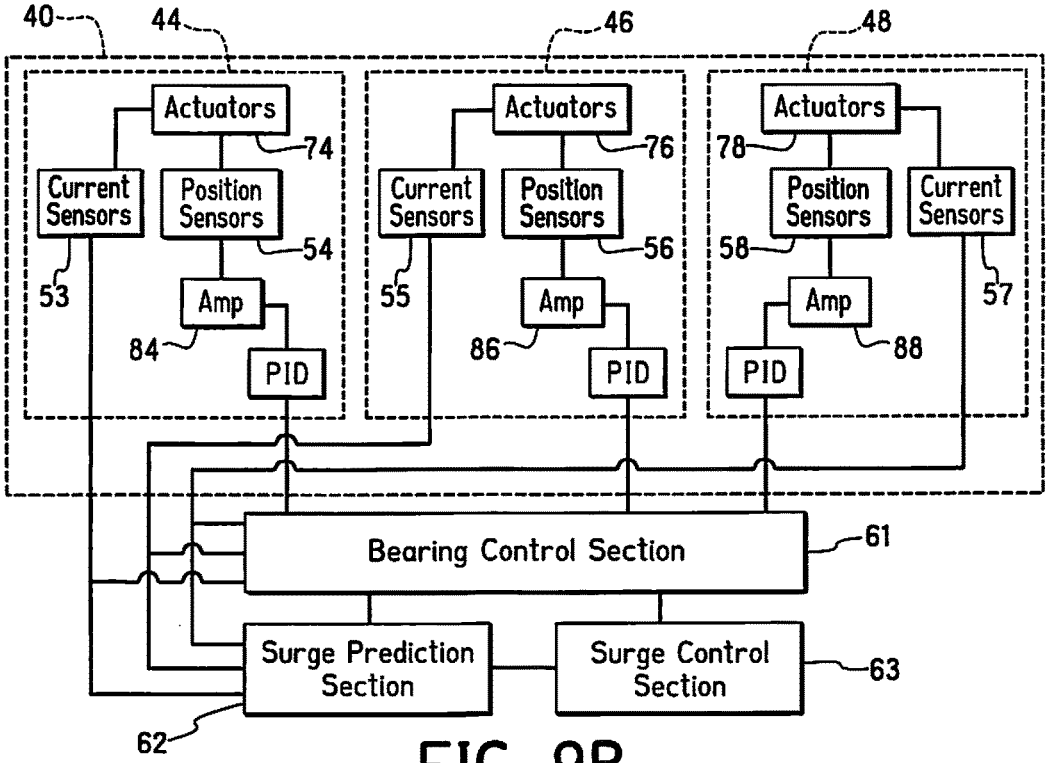
FIG. 9B is a schematic diagram illustrating a second exemplary arrangement of the magnetic bearing assembly and the magnetic bearing control section.
Figure 9C:
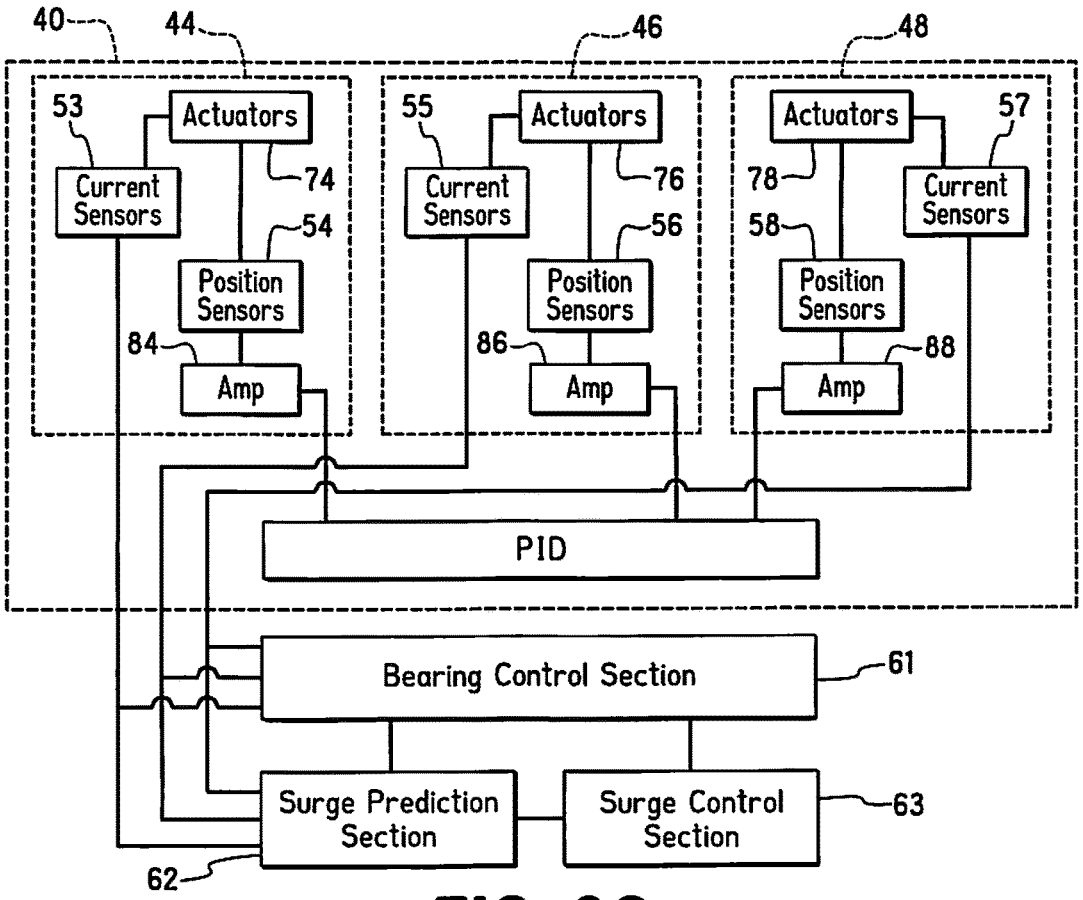
FIG. 9C is a schematic diagram illustrating a third exemplary arrangement of the magnetic bearing assembly and the magnetic bearing control section.

Referring to FIGS. 9A-9C, the magnetic bearing control section 61 is illustrated to be a portion of controller 20 as a single independent controller directly integrated into the magnetic bearings, connected to a plurality of PID controllers corresponding to the magnetic bearings, or connected to a single PID controller connected to each magnetic bearing. These are merely three examples of possible structures for the magnetic bearing control section 61 and are not intended to limit the invention as defined by the appended claims. The magnetic bearing control section 61 is electrically directly connected, or indirectly connected through one or more PID, to any of the sensors 53 to 58, and an amplifier 84, 86 or 88 of each respective magnetic bearing of the magnetic bearing assembly 40. Each magnetic bearing 44 includes a plurality of position sensors 54, a plurality of actuators 74 and at least one amp 84. Similarly, each the magnetic bearing 46 includes a plurality of position sensors 56, a plurality of actuators 76 and at least one amp 86. Likewise, each magnetic bearing 48 includes a plurality of position sensors 58, a plurality of actuators 78 and at least one amp 88. The amplifiers 84, 86 and 88 of each magnetic bearing 44, 46, and 48 may be a multi-channel amp to control the position sensors thereof, or can include separate amplifiers for each position sensor 54, 56 and 58. In either case, the amplifiers 84, 86 and 88 are electrically connected to the actuators 74, 76 and 78 of each respective magnetic bearing 44, 46, and 48.

Figure 4:
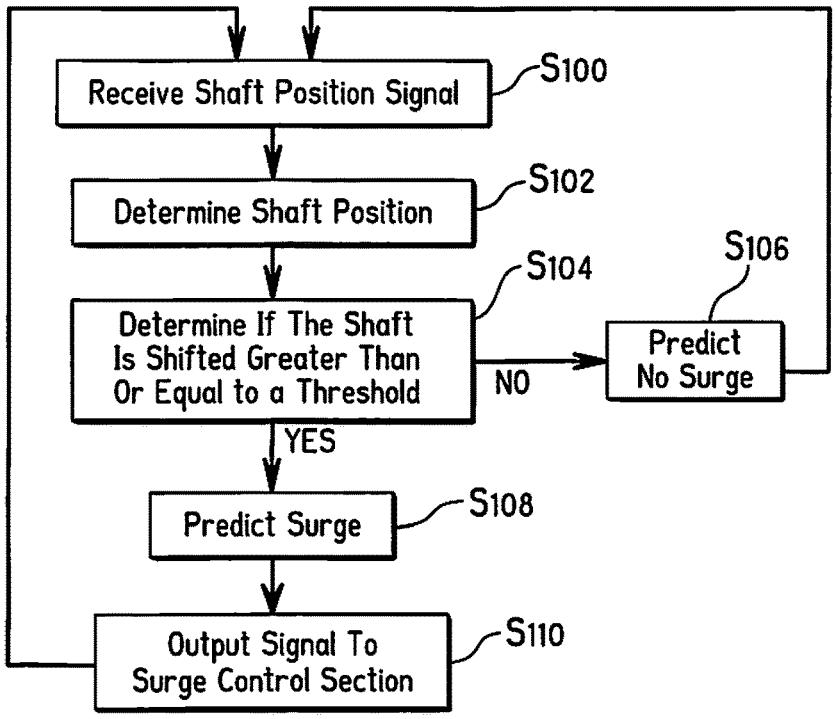
FIG. 4 is a flow chart illustrating a first method of surge prediction.

The magnetic bearing control section 61 is connected to current sensors 53, 55, and 57 in the case that the magnetic bearing control section 61 is to monitor current delivered to each actuator 74, 76 and 78 of the magnetic bearing assembly 40 (see FIG. 6); connected to position sensors 54, 56, and 58 in the case that the magnetic bearing control section 61 is to monitor the position of shaft 42 (see FIG. 4).

The magnetic bearing control section 61 is programmed to execute control of each respective actuator 74, 76 and 78 of the magnetic bearings 44, 46, and 48 to maintain a desired position of shaft 42. The magnetic bearing control section 61 controls the magnetic bearing assembly 40 by either generating or adjusting the control signal sent to each amplifier 84, 86 and 88 of the magnetic bearing assembly 40. The control signal indicates the current which each amp must output to a respective actuator 74, 76 and 78 of the magnetic bearing assembly 40. Each amplifier 84, 86 and 88 may have several channels to independently control each actuator 74, 76 and 78 of magnetic bearing assembly 40 respectively, each actuator 74, 76 and 78 of magnetic bearing assembly 40 may have a unique corresponding amplifier, or a combination as would be understood in light of the disclosure.

The magnetic bearings 44, 46, and 48 include current sensors 53, 55, and 57 disposed between the amplifier 84, 86 and 88 and the actuator 74, 76 and 78 of each magnetic bearing, respectively. The current sensors 53, 55, and 57 sense the current being provided to each actuator 74, 76 and 78 of the magnetic bearing assembly 40 by either monitoring the current output by each amplifier 84, 86 and 88 of the magnetic bearing assembly 40, or by monitoring the current provided to each amplifier 84, 86 and 88 of the magnetic bearing assembly 40 (not illustrated). The current sensors 53, 55, and 57 are connected to the surge prediction section 62, and generate current signals that indicate the current being provided to each actuator 74, 76 and 78 of the magnetic bearing assembly 40. In this manner, the surge prediction section 62 can be configured to monitor the current being supplied to the actuators 74, 76 and 78 of each of magnetic bearings 44, 46, and 48. Alternatively, the surge prediction section 62 may be configured to individually monitor the current supplied to any combination of the magnetic bearings 44, 46, and 48. The current sensors 53, 55, and 57 are used in the techniques illustrated in FIGS. 5-6, but the current sensors 53, 55, and 57 may be omitted in the technique illustrated in FIG. 4, unless used for some other purpose than surge prediction.

The variable frequency drive 64 and motor control section 65 receive signals from at least one motor sensor (not shown) and control the rotation speed of the motor 38 to control the capacity of the compressor 22 in a conventional manner. More specifically, the variable frequency drive 64 and motor control section 65 are programmed to execute one or more motor control programs to control the rotation speed of the motor 38 to control the capacity of the compressor 22 in a conventional manner. The inlet guide vane control section 66 receives signals from at least one inlet guide vane sensor (not shown) and controls the position of the inlet guide vane 32 to control the capacity of the compressor 22 in a conventional manner. More specifically, the inlet guide vane control section 66 is programmed to execute an inlet guide vane control program to control the position of the inlet guide vane 32 to control the capacity of the compressor 22 in a conventional manner. The expansion valve control section 67 controls the opening degree of the expansion valve 26 to control the capacity of the chiller system 10 in a conventional manner. More specifically, the expansion valve control section 67 is programmed to execute an expansion valve control program to control the opening degree of the expansion valve 26 to control the capacity of the chiller system 10 in a conventional manner. The motor control section 65 and the inlet guide vane control section 66 work together and with the expansion valve control section 67 to control the overall capacity of the chiller system 10 in a conventional manner. The controller 20 receives signals from the sensors S and optionally T to control the overall capacity in a conventional manner. The optional sensors T are temperature sensors. The sensors S are preferably conventional pressure sensors and/or temperature sensors used in a conventional manner to perform the control.

Referring now to FIGS. 2-8, structure and operation of the centrifugal compressor 22 will now be explained in more detail. As mentioned above, the centrifugal compressor 22 is adapted to be used in the chiller 10. The casing 30 has an inlet portion 31*a* and an outlet portion 31*b*. The inlet guide vane 32 is disposed in the inlet portion 31*a*. The impeller 34 is disposed downstream of the inlet guide vane 32. The impeller 34 is attached to the shaft 42, which is rotatable about a rotation axis X. The radial magnetic bearings 44 and 46 rotatably support the shaft 42. Thus, in the illustrated embodiment, there are a pair of radial magnetic bearings 44 and 46 disposed on opposite axial sides of the motor 38. In any case, at least one radial magnetic bearing 44 or 46 rotatably supports the shaft 42. The thrust magnetic bearing 48 supports the shaft 42 along the rotational axis X by acting on a thrust disk 45. The thrust magnetic bearing 48 includes the thrust disk 45 which is attached to the shaft 42. The thrust disk 45 extends radially from the shaft 42 in a direction perpendicular to the rotational axis X. The motor 38 is arranged and configured to rotate the shaft 42 in order to rotate the impeller 34. The diffuser 36 is disposed in the outlet portion 31*b* downstream from the impeller 34 with an outlet port of the outlet portion 31*b* disposed between the impeller 34 and the diffuser 36.

Figure 7:
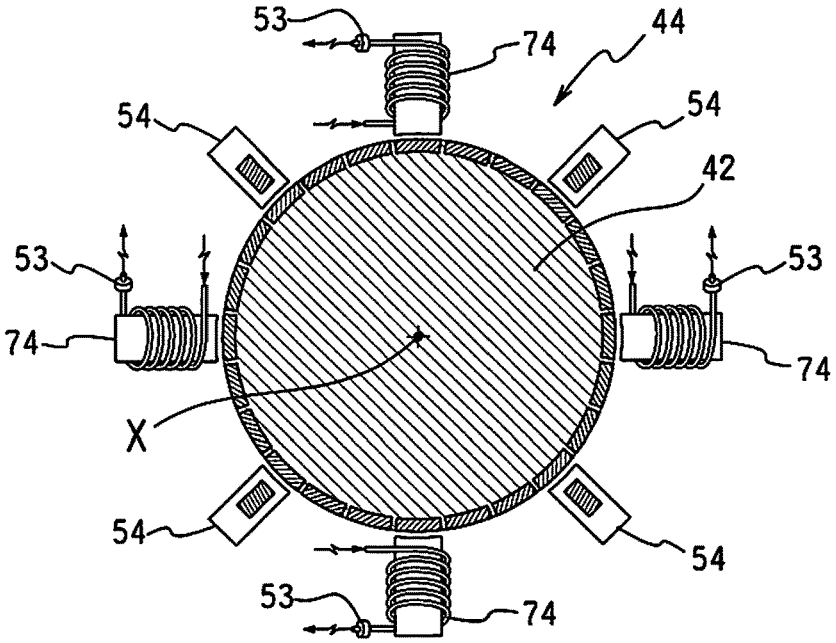
FIG. 7 is an axial view of the shaft of the rotational magnetic bearing illustrating a location of a radial magnetic bearing.
Figure 10A:
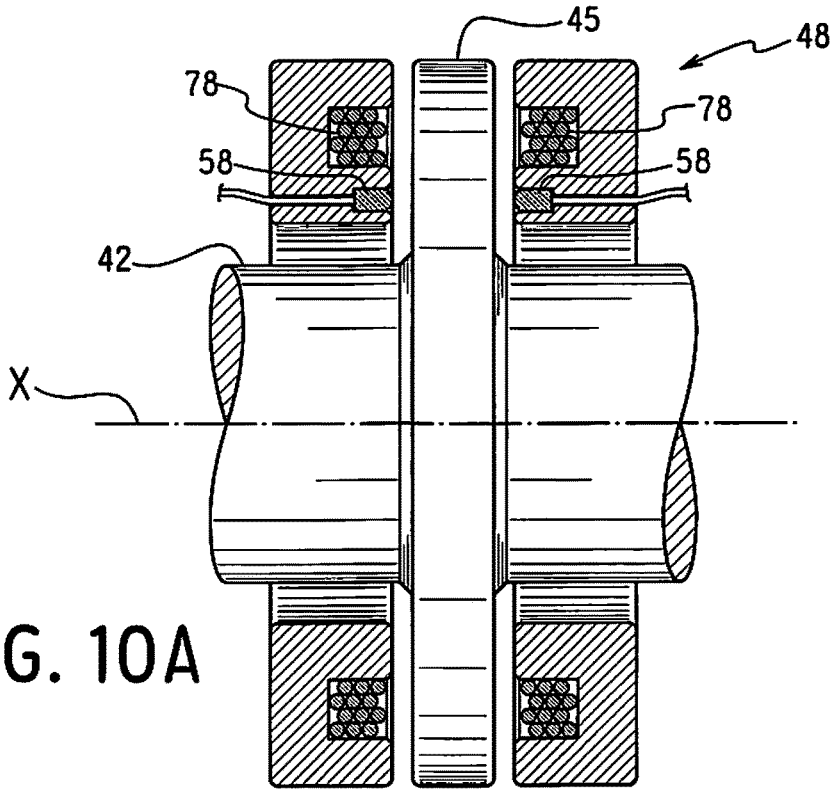
FIG. 10A is a partial cross-sectional plan view of the magnetic thrust bearing of FIGS. 2 and 3.
Figure 10B:
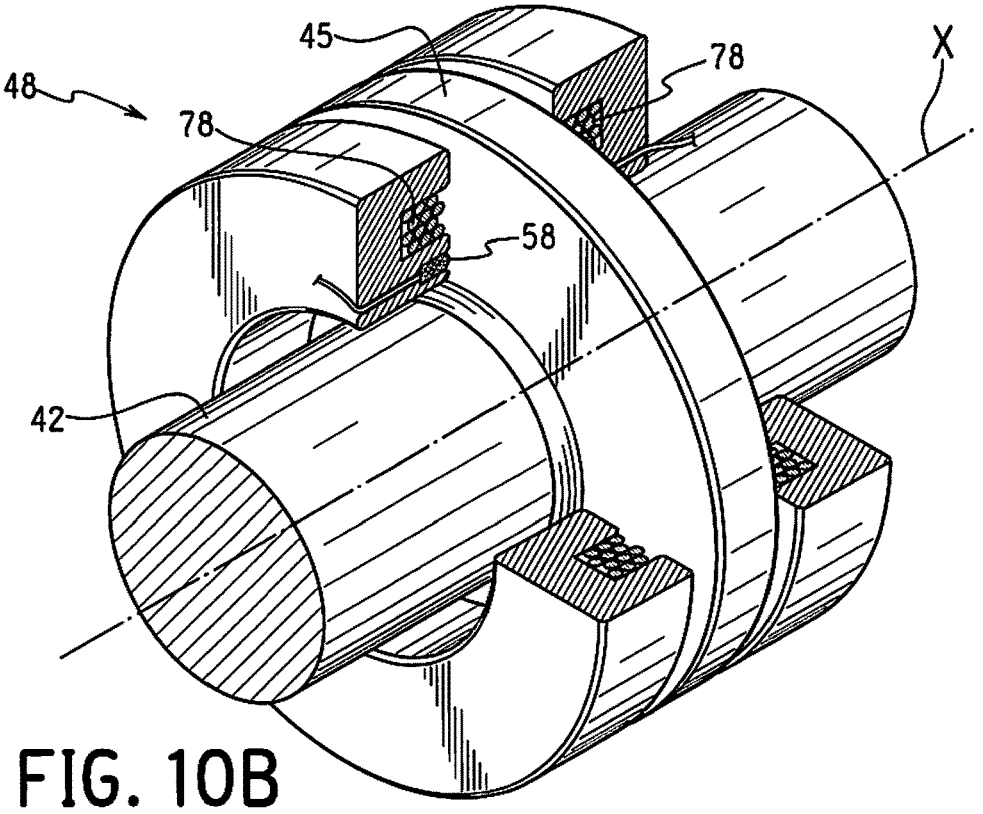
FIG. 10B is a cutout perspective view of the magnetic thrust bearing of FIGS. 2 and 3.

Referring to FIGS. 7, 10A and 10B, the position sensors 54, 56, and 58 sense the location of the shaft 42. The position sensors 54 are illustrated as being axially offset from the actuators 74 for the sake of illustration, but may be disposed on the same plane as the actuators 74 of magnetic bearing 44. Unnumbered backup (mechanical) bearings are located axially adjacent the position sensors 54 and 56 in a conventional manner. Likewise, the position sensors 56 are illustrated as being axially offset from the actuators 76 for the sake of illustration, but may be disposed on the same plane as the actuators 76 of magnetic bearing 46. The position sensors 54 and 56 detect a radial position of the shaft 42. Preferably, the magnetic bearing 44 includes four position sensors 54 radially arranged about shaft 42 as illustrated in FIG. 7, and the magnetic bearing 46 has a configuration identical to the magnetic bearing 44, except the location of the magnetic bearing 46. Thus, the magnetic bearing 46 also includes four position sensors 56 radially arranged about shaft 42 (not all illustrated). The position sensors 58 detect the axial position of shaft 42 along rotational axis X, and are disposed axially offset from the thrust disk 45. Preferably, magnetic bearing 48 includes two position sensors 58, each of the position sensors 58 being disposed on opposite sides of the thrust disk 45 as illustrated in FIGS. 10A and 10B.

All of the position sensors 54, 56, and 58 output a positional signal which indicates the position of the shaft 42. The position sensors 54 output positional signals indicating the position of the shaft 42 at magnetic bearing 44. The position sensors 56 output positional signals indicating the position of the shaft 42 at magnetic bearing 46. The position sensors 58 output positional signals indicating the axial position of the thrust disk 45 of the shaft 42. Because only certain movements of the impeller 34 may be relevant to predicting surge, a position signal may be any combination of the positional signals indicating the position of shaft 42 from the position sensors 54, 56, and 58. By non-limiting example, surge may be predicted by monitoring for any changes to the rotational axis X at one of the rotational magnetic bearings 44 and 46; a change in the axial position of shaft 42 at magnetic bearing 48; or changes in position of shaft 42 indicated at positions monitored by any combination of magnetic bearings 42, 44, and 46. The position sensors 54, 56, and 58 may send the position signal to the magnetic bearing control section 61 directly, or indirectly through one or more PID. The surge prediction section 62 may receive the position signal directly from the position sensors 54, 56, and 58; indirectly through one or more PID; or from the bearing control section 61.

During operation, the magnetic bearing control section 61, or one or more PID, receive the positional signals and generates control signals. A control signal is sent to each amplifier 84, 86 and 88 of the magnetic bearing assembly 40. Each control signal indicates an amount of current to be output by a corresponding amplifier 84, 86 and 88 of the magnetic bearing assembly 40. The magnetic bearing control section 61, or one or more PID, is programmed to calculate the control signal based on the positional signals. The magnetic bearing control section 61 preferably shares at least one of the positional information and the control signals of with the various components of controller 20 such as surge prediction section 62. The control signals are generated based on the positional signals.

The surge prediction section 62 of controller 20 is programmed to predict surge in accordance with the present invention. The surge prediction section 62 predicts surge based on at least one of the position signal (FIG. 4), the current signal (FIG. 6), and the force or control signal (FIG. 5), as described in further detail below. The surge prediction section 62 may be executed by the hardware and/or software of controller 20, or may be independently implemented one or more outside controllers as mentioned above.

According to a first method as illustrated in FIG. 4, the surge prediction section 62 can be programmed to predict surge based on the position signal. In S100, the surge prediction section 62 receives the position signal, and determines a shaft position value as indicated by the position signal in S102. In S104, the surge prediction section 62 then compares the shaft position value as indicated by the position signal with a predetermined position value. The predetermined position value is usually an ideal shaft position, and by comparing the shaft position value with the predetermined position value, the surge prediction section 62 determines an amount the shaft 42 has shifted. The predetermined position value is set based on the components and size of the chiller system 10 based on experiments conducted by the manufacturer. Alternatively, testing can occur onsite to determine such values. If the shaft position value indicated by the position signal differs from the predetermined position value by an amount equal to or greater than a threshold in S104, the surge prediction section 62 proceeds to S108 in which the surge prediction section 62 predicts that surge will occur. In S110, upon predicting that surge will occur, the surge prediction section 62 outputs a signal to the surge control section 63 indicating that surge will occur. Since vibration occurs during surge, displacement amount is indicative of vibration amount. Therefore, displacement amount can be used to determine vibration amount, which indicates surge can be predicted.

After outputting the signal in S110, the surge prediction section 62 returns to S100, i.e. receiving the position signal. If the shaft position value indicated by the position signal differs from the predetermined position value by an amount less than the threshold in S104, the surge prediction section 62 proceeds to S106 in which the surge prediction section 62 predicts that no surge will occur. Upon predicting that no surge will occur in S106, the surge prediction section 62 returns to receiving the position signal in S100. It will be apparent to one of ordinary skill in the art in light of the disclosure, that the method to predict surge based on the position value of the shaft 42 may be determined in alternative manners in light of the disclosure.

Figure 5:
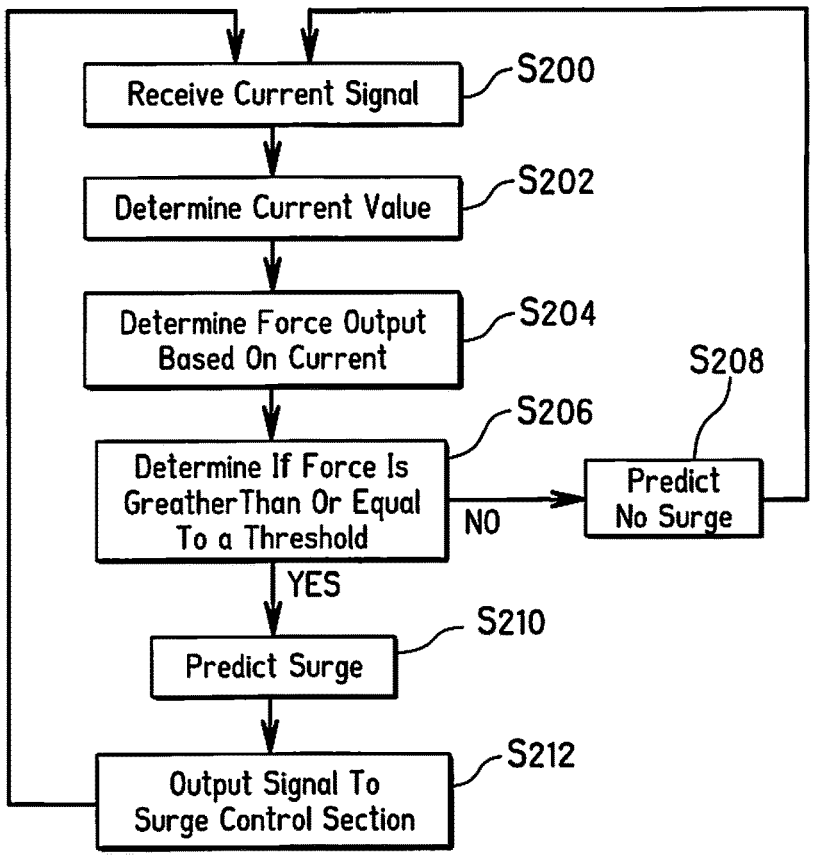
FIG. 5 is a flow chart illustrating a second method of surge prediction.

According, to a second method as illustrated in FIG. 5, the surge prediction section 62 can be programmed to predict surge based on force output by each actuator 74, 76 and 78, which can be calculated based on the current signal(s) sensed by the current sensors 53, 55 and 57 as well as other information. By way of non-limiting example, in S200, the surge prediction section 62 receives the current signals from any combination of current sensors 53, 55, and 57. In S202, the surge prediction section 62 determines the current value that is being supplied to individual magnetic bearings 44, 46, and 48 based on the current signals from the current sensors 53, 55, and 57. The value for force output by each actuator 74, 76 and 78 may then be determined using the following equation.

$$F = \frac{\mu N^2 i^2 A}{4g^2}$$

Wherein is the force output, μ is the magnetic permeability of the magnet of the actuator, N is the number of coil turns of the actuator, i is the current supplied to, the actuator, A is the pole face area of the actuator, and g is the air gap thickness between the actuator and the shaft 42, or thrust disk 45, respectively. In S204, the surge prediction section 62 then calculates a force output by aggregating the force output at each actuator 74, 76 and 78 of each respective magnetic bearing 44, 46, and 48, respectively. In S206, the surge prediction section 62 then compares the force value output by each actuator 74, 76 and 78 to a predetermined set of force values for each of magnetic bearings 44, 46, and 48, respectively.

The predetermined set of force values are set based on the components and size of the chiller system 10 based on experiments conducted by the manufacturer. Alternatively, testing can occur onsite to determine such values. If any of the force values calculated from the current signal differs from the predetermined set of force values for each actuator 74, 76 and 78 by an amount greater than a threshold value, the surge prediction section 62 continues to S210 and predicts that surge will occur. Upon predicting that surge will occur, the surge prediction section 62 proceeds to S212 and outputs a signal to the surge control section 63 indicating the prediction that surge will occur, and returns to receiving the current signal in S200. If any of the force values calculated from the current signal differs from the predetermined position value by an amount less than a threshold in S206, the surge prediction section 62 predicts that no surge will occur in S208. Upon predicting that no surge will occur, the surge prediction section 62 returns to receiving the current signal in S200. It will be apparent to one of ordinary skill in the art in light of the disclosure, that the method to predict surge based on the force values for each actuator 74, 76 and 78 and/or the exact method of calculating force for each actuator 74, 76 and 78 may be determined in alternative manners without departing from the scope of the present invention.

Figure 6:
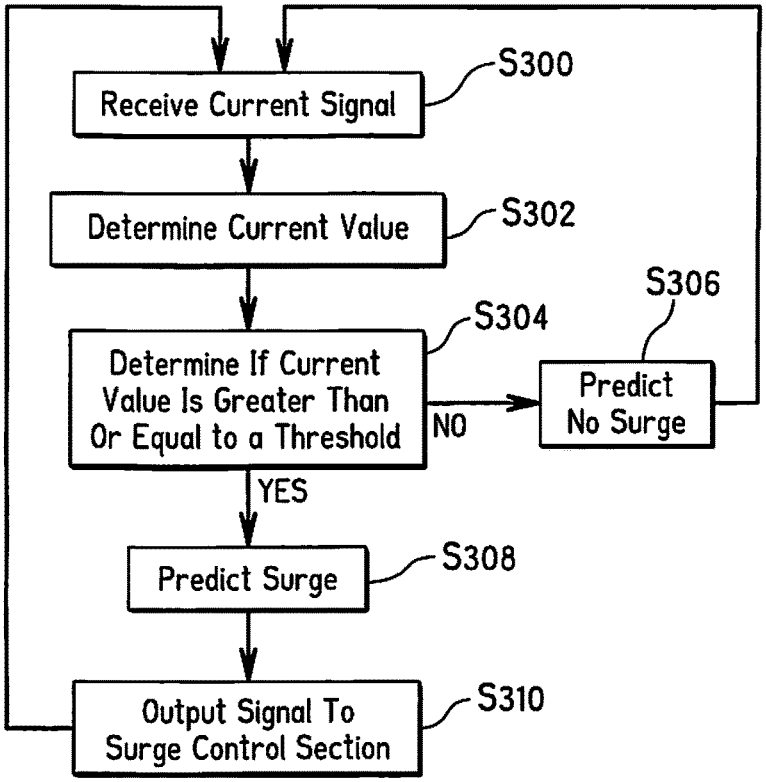
FIG. 6 is a flow chart illustrating a third method of surge prediction.

According to a third method as illustrated in FIG. 6, the surge prediction section 62 may be programmed to predict surge based on the current signal(s) output to the actuators 74, 76 and 78. The current signal(s) can be sensed by the current sensors 53, 55 and 57 or may be based on a control signal indicative of this information. By way of non-limiting example, in S300, the surge prediction section 62 receives the current signals from any combination of current sensors 53, 55, and 57. The surge prediction section 62 proceeds to S302, in which the surge prediction section 62 determines a current value for each of the magnetic bearings 44, 46, and 48. In S304, the surge prediction section 62 then compares the current value that is to be supplied to each actuator 74, 76 and 78 of the magnetic bearing section 40 to a predetermined set of current values for each actuator 74, 76 and 78 of the magnetic bearing section 40. If any of the current values indicated by the control signals differ from the predetermined set of control values for each of the magnetic bearings 44, 46, and 48 by an amount greater than a threshold value in S304, the surge prediction section 62 predicts that surge will occur in S308. Alternatively, the current signal(s) can be sensed by the current sensors 53, 55 and 57 and compared directly to threshold values. In either case, the threshold values are set based on the components and size of the chiller system 10 based on experiments conducted by the manufacturer. Alternatively, testing can occur onsite to determine such values. Upon predicting that surge will occur in S308, the surge prediction section 62 outputs a signal to the surge control section 63 indicating the prediction that surge will occur and returns to receiving the control signal in S310. If any of the control values calculated from the control signals differ from the predetermined control values by an amount less than a threshold in S304, the surge prediction section 62 predicts that no surge will occur in S306. Upon predicting that no surge will occur in S306, the surge prediction section 62 returns to receiving the control signal in S300. It will be apparent to one of ordinary skill in the art in light of the disclosure, that the method to predict surge based on the control signal may be determined in alternative manners if needed and/or desired.

The surge control section 63 is programmed to prevent surge. The surge control section 63 is electrically connected to the surge prediction section 62. The surge control section 63 is also electrically connected to at least one of the variable frequency drive 64, the motor control section 65, the inlet guide vane control section 66, and the expansion valve control section 67. The surge control section 63 is programmed to prevent surge, upon receiving the signal predicting surge will occur, by adjusting an operation of the chiller system 10. By non-limiting example, the surge control section 63 may be programmed to increase an operation range of the compressor 22 in response to a signal indicating surge from the surge prediction section 62.

More specifically, by non-limiting example, the surge control section 63 may increase the operation range of the compressor 22 by adjusting the control of at least one of the motor control section 65 and the inlet guide vane control section 66. The surge control section 63 may adjust the control of the motor speed via the motor control section 65 in a manner that increases the operation range of the compressor 22. Similarly, the surge control section 63 may adjust the inlet guide vane position via the inlet guide vane control section 66 in a manner that increases the operation range of the compressor 22. It should be apparent to one of ordinary skill in the art, in light of this disclosure, that conventional methods of preventing surge may also be implemented by the surge control section 63.

Figure 8:
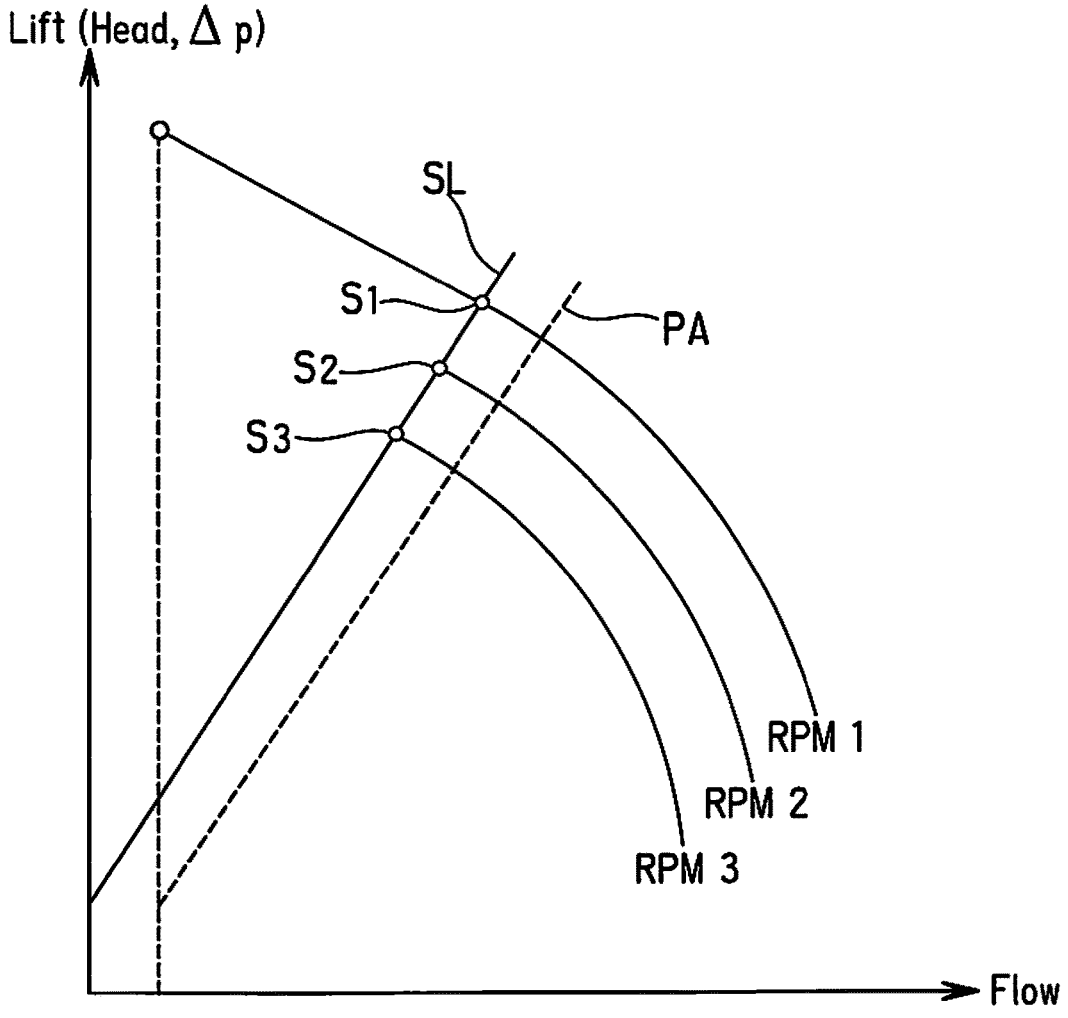
FIG. 8 is graph illustrating head as compared to flow rate for three different rpm of the centrifugal compressor, with a surge line illustrated.

Referring to FIG. 8, surge is the complete breakdown of steady flow in the compressor, which typically occurs at a low flow rate. FIG. 8 illustrates a surge line SL, which connects the surge points S2, S2, and S3 at rpm1, rpm2, and rpm3, respectively. These points are the peak points in which pressure generated by the compressor is less than the pipe pressure downstream of the compressor. These points illustrate initiation of the surge cycle. Broken line PA illustrates a surge control line. The distance between line PA and SL show the inefficiency of surge control methods. By reducing the difference between a surge control line PA and surge line SL, the compressor 22 can be controlled to be more efficient. One advantage of the aforementioned surge detection methods is that it is more accurate than previously known methods of detecting surge; thus the surge control line PA may be closer to surge line SL when compared to previous methods.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A centrifugal compressor adapted to be used in a chiller, the centrifugal compressor comprising:

a casing having an inlet portion and an outlet portion;

an inlet guide vane disposed in the inlet portion;

an impeller disposed downstream of the inlet guide vane, the impeller being attached to a shaft rotatable about a rotation axis, at least one radial magnetic bearing rotatably supporting the shaft;

an axial magnetic bearing attached to the shaft;

at least one radial magnetic bearing sensor arranged with respect to the radial magnetic bearing and configured to detect at least one of a radial position signal indicative of the shaft's position in a radial direction and a radial magnetic bearing current signal indicative of current supplied to the at least one radial magnetic bearing;

a plurality of axial magnetic bearing sensors arranged with respect to the axial magnetic bearing, each of the axial magnetic bearing sensors being configured to detect at least one of an axial position signal indicative of the shaft's position in an axial direction and an axial magnetic bearing current signal indicative of current supplied to the axial magnetic bearing;

a motor arranged and configured to rotate the shaft in order to rotate the impeller;

a diffuser disposed in the outlet portion downstream from the impeller with an outlet port of the outlet portion being disposed between the impeller and the diffuser; and a controller programmed to predict surge based on the radial position signal and the axial position signals, or based on the radial magnetic bearing current signal and the axial magnetic bearing current signals.

2. The centrifugal compressor according to claim 1, wherein the controller is further programmed to adjust an operation of the centrifugal compressor based on a surge being predicted.

3. The centrifugal compressor according to claim 2, wherein the controller is further programmed to increase an operation range of the centrifugal compressor based on the surge being predicted.

4. The centrifugal compressor according to claim 3, wherein at least one of inlet guide vane position and motor speed is adjusted to increase the operation range of the centrifugal compressor.

5. The centrifugal compressor according to claim 1, wherein the at least one radial magnetic bearing sensor is a radial position sensor arranged to detect the radial position signal, the axial magnetic bearing sensors are axial position sensors arranged to detect the axial position signals, and the controller is programmed to predict surge by comparing the radial position signal and the axial position signals to threshold values.

6. The centrifugal compressor according to claim 5, wherein the axial magnetic bearing is a magnetic thrust bearing that includes a thrust disk, and the plurality of axial magnetic bearing sensors includes two of the axial position sensors, each of the axial position sensors being disposed on opposite sides of the thrust disk.

7. The centrifugal compressor according to claim 1, wherein the at least one radial magnetic bearing sensor is a radial magnetic bearing current sensor arranged to detect the radial magnetic bearing current signal, and the axial magnetic bearing sensors are axial magnetic bearing current sensors arranged to detect the axial magnetic bearing current signals.

8. The centrifugal compressor according to claim 7, wherein the controller is programmed to predict surge by comparing the radial magnetic bearing current signal and the axial magnetic bearing current signals to threshold values.

9. The centrifugal compressor according to claim 7, wherein the controller is programmed to calculate a radial magnetic bearing force of the at least one radial magnetic bearing based on the radial magnetic bearing current signal, calculate axial magnetic bearing forces of the axial magnetic bearing based on the axial magnetic bearing current signals, compare the calculated radial magnetic bearing force and axial magnetic bearing forces to predetermined force values, and predict surge based on the comparison of the calculated radial magnetic bearing force and axial magnetic bearing forces to the predetermined force values.

10. The centrifugal compressor according to claim 1, wherein the at least one radial magnetic bearing includes a first radial magnetic bearing disposed axially between the motor and the impeller along the shaft, and a second radial magnetic bearing disposed on an opposite side of the motor from the first radial magnetic bearing along the shaft so that the motor is disposed axially between the first and second radial magnetic bearings.

* * * * *